US005370500A

United States Patent [19]

Thompson

[11] Patent Number: 5,370,500

[45] Date of Patent: Dec. 6, 1994

[54] OSCILLATING FAN SUPPORT

[76] Inventor: Jerry E. Thompson, 1826 S. K St., Elwood, Ind. 46036

[21] Appl. No.: 212,049

[22] Filed: Mar. 14, 1994

[51] Int. Cl.[5] ..... F04D 29/60

[52] U.S. Cl. ..... 416/100; 248/125; 248/676

[58] Field of Search ..... 416/100, 244 R, 246; 248/676, 125

[56] References Cited

U.S. PATENT DOCUMENTS 672,303 4/1901 Williams ..... 416/246
4,589,622 5/1986 Hutter ..... 248/676

FOREIGN PATENT DOCUMENTS 185893 10/1984 Japan ..... 416/100
168995 7/1987 Japan ..... 416/100
8771 6/1915 United Kingdom ..... 416/100

*Primary Examiner*—John T. Kwon
*Attorney, Agent, or Firm*—Michael J. Colitz, Jr.

[57] ABSTRACT

A fan support for supporting a fan in an elevated position and oscillating the fan about the support. The device includes an adjustable column supported in a vertical position by a plurality of legs. A fan support channel is pivotally mounted to a top end of the column and is operable to receive and support a fan, such as a box shaped fan, thereon. An oscillation device is provided to effect a repetitive pivoting movement of the support channel in the horizontal plane, and a thermostat for controlling operation of both the fan and the oscillation device is also included.

6 Claims, 4 Drawing Sheets

OSCILLATING FAN SUPPORT

BACKGROUND OF THE INVENTION

1. Field of the Invention

The present invention relates to support structures and more particularly pertains to a support for supporting a fan in an elevated position and oscillating the fan about the support.

2. Description of the Prior Art

The use of support structures is known in the prior art. More specifically, support structures heretofore devised and utilized for the purpose of oscillating a fan are known to consist basically of familiar, expected and obvious structural configurations, notwithstanding the myriad of designs encompassed by the crowded prior art which have been developed for the fulfillment of countless objectives and requirements.

For example, an oscillating fan is illustrated in U.S. Pat. No. 4,732,539 which has a neck joint that is mounted for tilting movement back and forth on the top of an upwardly projecting portion of a base, with a fan unit mounted on top of the neck joint for oscillating movement on the neck joint about a vertical axis. The neck joint allows the fan to be folded downward so as to place the fan in a collapsed or folded position.

An oscillator mechanism for a fan is disclosed in U.S. Pat. No. 3,713,346 in which a ratchet arm and a crank arm are joined by a connecting link, with the crank arm being driven by the fan motor through a reduction gear mechanism. The fan proper is attached to a vertical swivel shaft adapted to rotate in a bore in an oscillator member fixed to a stand.

Another patent of interest is U.S. Pat. No. 3,945,769 which teaches a self-oscillating fan having a single degree of freedom to torsionally oscillate in a horizontal plane. In one version, the fan oscillates about a fixed vertical axis and is self-excited by an aerodynamic couple created by feathering vertically disposed vanes which are symmetrically located adjacent the tips of the fan blades on the air in flow side thereof. In another version, the fan oscillates about a pendulous axis and is self-excited by a precession of the rotating fan and motor armature as a pendulous gyro.

While these devices fulfill their respective, particular objectives and requirements, the aforementioned patents do not disclose a fan support for supporting a fan in an elevated position and oscillating the fan about the support which includes an adjustable column supported in a vertical position by a plurality of legs with a fan support channel pivotally mounted to a top end of the column for receiving and supporting a fan, and an oscillation means to effect a repetitive pivoting motion of the support channel about a vertical axis. Furthermore, none of the known prior art support structures teach or suggest an oscillating fan support of the aforementioned structure which further includes a thermostat for controlling an operation of both the fan and the oscillation means.

In these respects, the oscillating fan support according to the present invention substantially departs from the conventional concepts and designs of the prior art, and in so doing provides an apparatus primarily developed for the purpose of supporting a fan in an elevated position and oscillating the fan about a vertical axis.

SUMMARY OF THE INVENTION

In view of the foregoing disadvantages inherent in the known types of support structures now present in the prior art, the present invention provides a new oscillating fan support construction wherein the same can be utilized for supporting a fan in an elevated position and oscillating the fan about a vertical axis. As such, the general purpose of the present invention, which will be described subsequently in greater detail, is to provide a new oscillating fan support apparatus which has many of the advantages of the support structures mentioned heretofore and many novel features that result in a oscillating fan support which is not anticipated, rendered obvious, suggested, or even implied by any of the prior art support structures, either alone or in any combination thereof.

To attain this, the present invention generally comprises a fan support for supporting a fan in an elevated position and oscillating the fan about the support. The device includes an adjustable column supported in a vertical position by a plurality of legs. A fan support channel is pivotally mounted to a top end of the column and is operable to receive and support a fan, such as a box shaped fan, thereon. An oscillation means is provided to effect a repetitive pivoting movement of the support channel in the horizontal plane, and a thermostat for controlling operation of both the fan and the oscillation means is also included.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new oscillating fan support apparatus which has many of the advantages of the support structures mentioned heretofore and many novel features that result in a oscillating fan support which is not anticipated, rendered obvious, suggested, or even implied by any of the prior art support structures, either alone or in any combination thereof.

It is another object of the present invention to provide a new oscillating fan support which may be easily and efficiently manufactured and marketed.

It is a further object of the present invention to provide a new oscillating fan support which is of a durable and reliable construction.

An even further object of the present invention is to provide a new oscillating fan support which is susceptible of a low cost of manufacture with regard to both materials and labor, and which accordingly is then susceptible of low prices of sale to the consuming public, thereby making such oscillating fan supports economically available to the buying public.

Still yet another object of the present invention is to provide a new oscillating fan support which provides in the apparatuses and methods of the prior art some of the advantages thereof, while simultaneously overcoming some of the disadvantages normally associated therewith.

Still another object of the present invention is to provide a new oscillating fan support for supporting a fan in an elevated position and oscillating the fan about a vertical axis.

Yet another object of the present invention is to provide a new oscillating fan support which includes an adjustable column supported in a vertical position by a plurality of legs with a fan support channel pivotally mounted to a top end of the column for receiving and supporting a fan thereon, and oscillation means for effecting a repetitive, pivoting motion of the support channel in a horizontal plane.

Even still another object of the present invention is to provide a new oscillating fan support having the aforementioned structure and further including a thermostat for controlling operation of both the fan and the oscillation means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
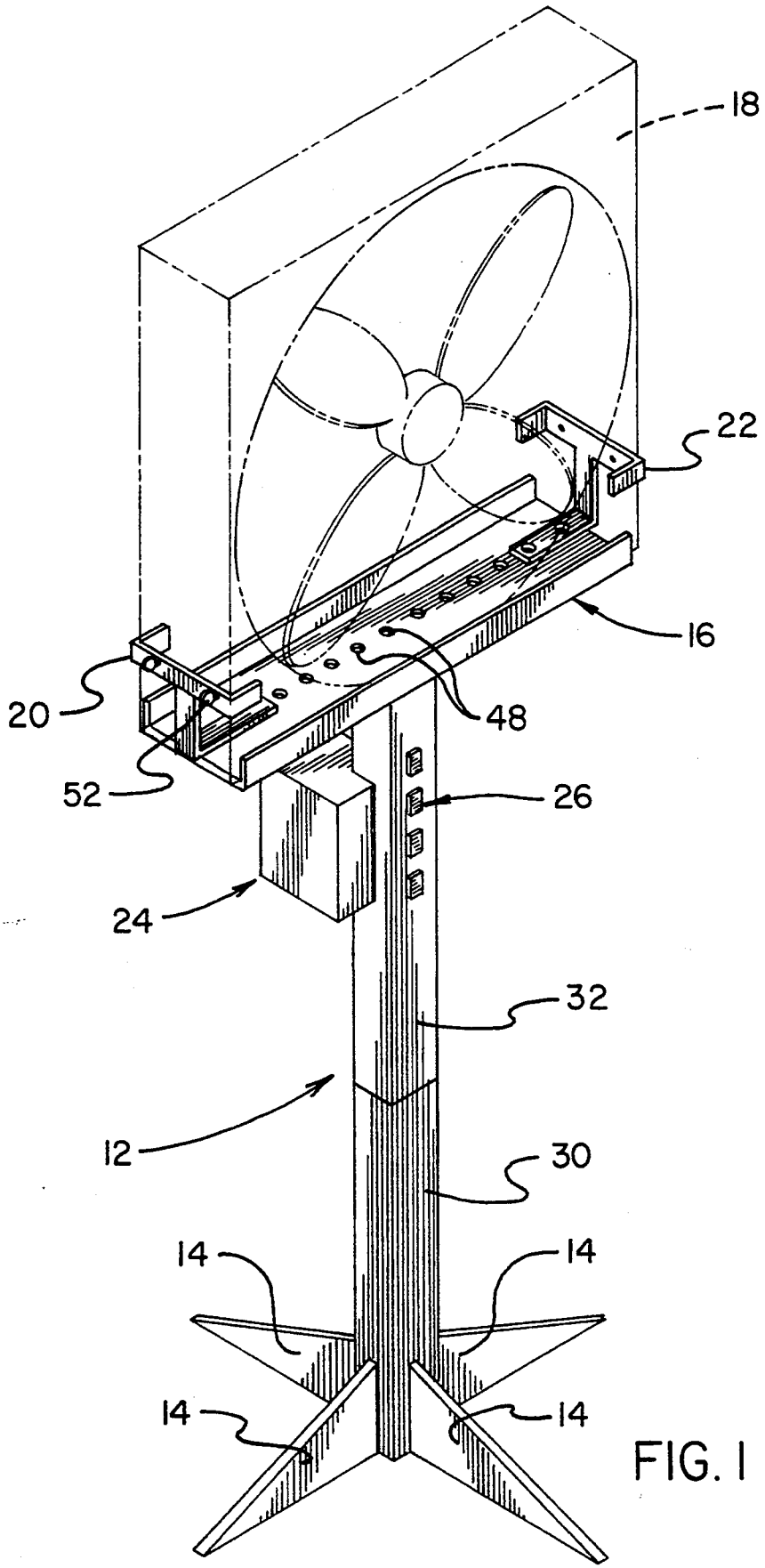
FIG. 1 is an isometric illustration of an oscillating fan support comprising the present invention with a fan installed thereon.

With reference now to the drawings, and in particular to FIGS. 1–7 thereof, a new oscillating fan support embodying the principles and concepts of the present invention and generally designated by the reference numeral 10 will be described.

From an overview standpoint, the oscillating fan support 10 generally comprises a main support column 12 which is supported in a vertical position by a plurality of radially extending legs 14, as best illustrated in FIG. 1. The main support column 12 includes an unlabelled top end upon which a fan support channel 16 is pivotally mounted. The fan support channel 16 is operable to receive and support a fan 18 thereon, and a pair of end brackets 20, 22 are selectively engagable to the support channel and operable to securely mount the fan thereto.

An oscillation means 24 is coupled to the main support column 12 and operable to effect a repetitive, pivotal motion of the fan support channel 16 about a vertical axis defined by a longitudinal axis of the main support column 12. An oscillation speed control means 26 is electrically coupled to the oscillation means to effect selective control of the speed of such pivotal motion. In addition, a thermostat 28 is provided to selectively deenergize both the oscillation means 24 and the fan 18 in accordance with a preselected ambient room temperature.

Figure 7:
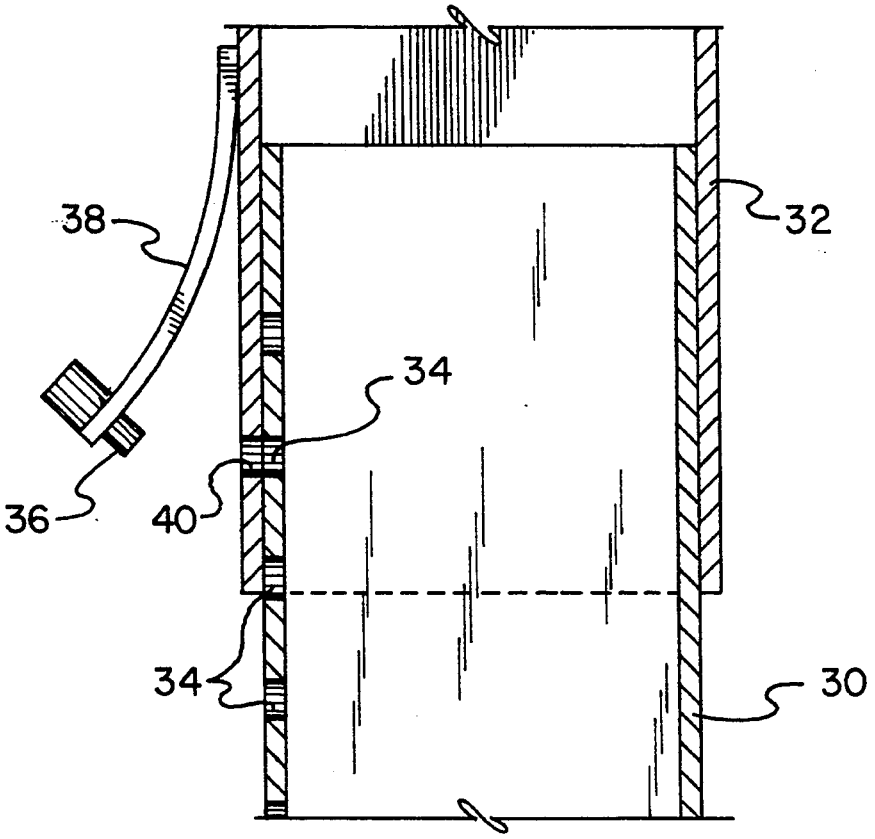
FIG. 7 is a cross sectional view detailing a telescoping and locking feature of the support column.

More specifically, it will be noted that the oscillating fan support comprises a main support column 12 in which a first support column 30 is provided with a plurality of radially extending legs 14 which cooperate to support the first support column in a substantially vertical orientation upon an unillustrated ground surface. A second support column 32 is telescopically received over the first support column 30. The first support column 30 is provided with a plurality of adjustment apertures 34 such that an adjustment pin 36, biased by a resilient pin support 38, may be positioned through both a second support aperture 40 and one of the plurality of adjustment apertures, as best illustrated in FIG. 7 of the drawings.

Figure 4:
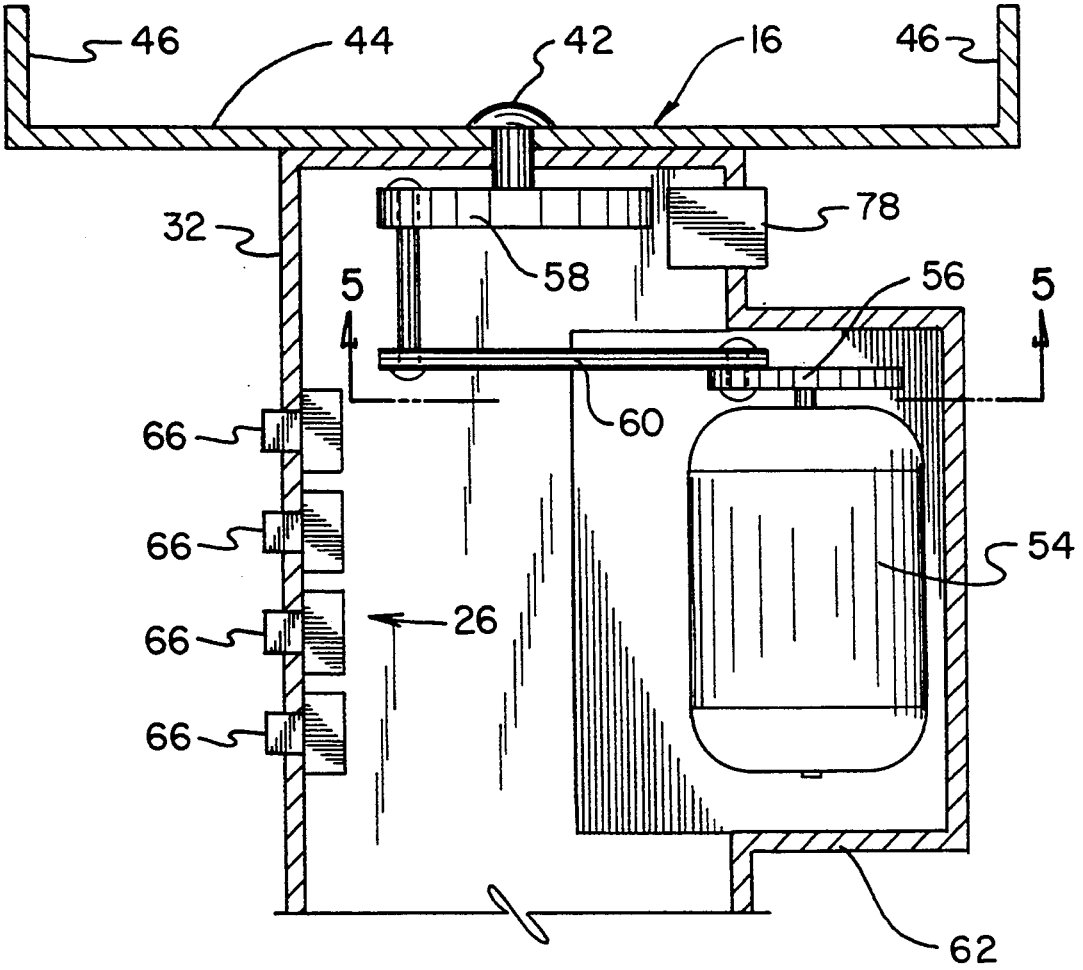
FIG. 4 is an enlarged, cross sectional view of a portion of the invention taken along line 4—4 of FIG. 2.

As best illustrated in FIGS. 1 and 4, a fan support channel 16 is pivotally mounted to an unlabelled top end of the second support column 32 by an axle 42. The fan support channel 16 includes a substantially elongated, planer base plate 44 with a pair of orthogonally oriented, upwardly extending side walls 46 which extend along longitudinal sides of the base plate, such that a fan 18 may be positioned between the side walls. The fan support channel 16 includes a plurality of longitudinally arranged apertures 48 which are equally spaced and serve as a mounting means for a pair of end brackets 20, 22 to further support the fan 18 within the fan support channel.

Figure 2:
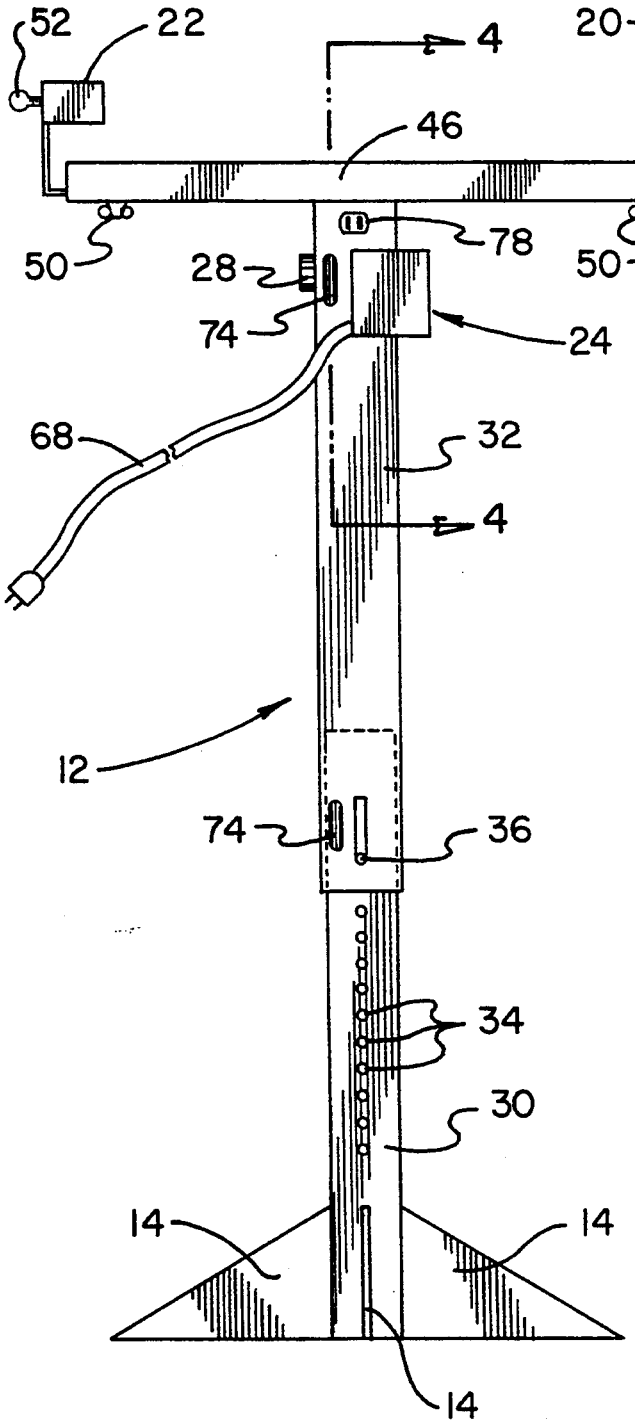
FIG. 2 is a rear elevation view of the invention.
Figure 3:
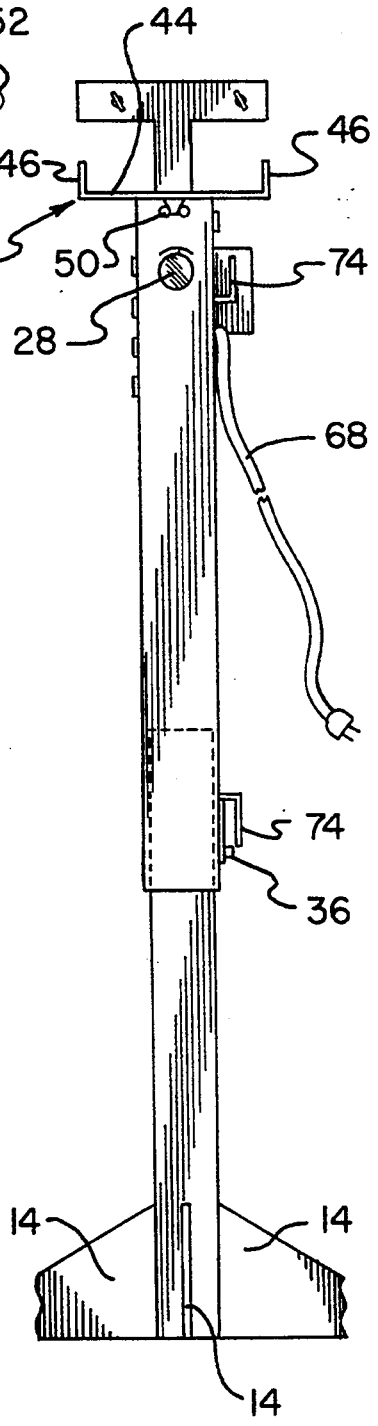
FIG. 3 is a side elevation view of the present invention.

As best illustrated in FIG. 2, the end brackets 20, 22 can be secured in a plurality of positions along the longitudinal length of the fan support channel 16 by a stud which projects through one of the plurality of apertures 48 and a wing nut 50 selectively engagable to the stud in a threaded manner. To facilitate a fine adjustment of the longitudinal engagement of the end brackets 20, 22 against the fan 18, each of the end brackets is provided with a pair of thumb screws 52 which may be selectively tightened to further secure the fan 18 to the fan support channel 16. By this structure, the fan 18 may be selectively positioned upon the fan support channel 16, whereby the thumb screws 52 may be tightened against the fan. For smaller fans, such as those provided with a smaller base member, the end brackets 20, 22 may be positioned closer together, whereby such smaller fan may be secured thereto in a similar manner.

To selectively pivot the fan support channel 16 about a vertical axis defined by the main support column 12, an oscillation means 24 is provided. As best illustrated in FIG. 4, it can be shown that the oscillation means 24 comprises a motor 54 having a motor wheel 56 attached to the motor shaft. In the preferred embodiment, the motor 54 includes an internal gear reduction arrangement which reduces a rotational speed of the motor wheel 56. An axle wheel 58 is coupled to the axle 42 such that a rotation of the axle wheel will result in a rotation of the fan support channel 16 upon the top end of the second support column 32. A push rod 60 mechanically couples the motor wheel 56 to the axle wheel 58 such that a rotation of the motor wheel will impart an oscillating motion to the axle wheel.

Figure 5:
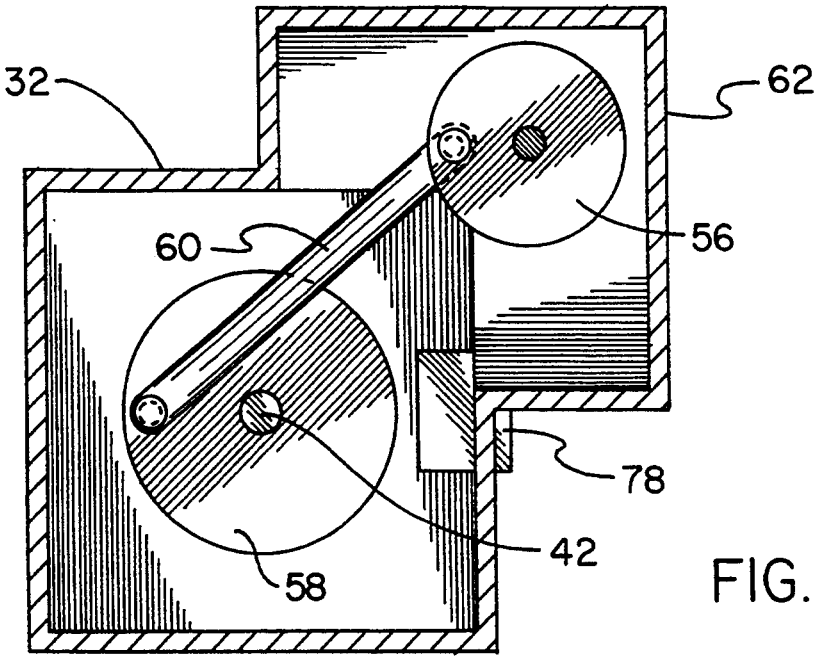
FIG. 5 is a further cross sectional view taken along line 5—5 of FIG. 4.

To accomplish such oscillating motion, the axle wheel 58 should be of a diameter greater than a diameter of the motor wheel 56, as clearly shown in the illustrated of FIG. 5. Although the oscillation means 24 is illustrated as having circular wheels 56, 58, it is to be understood that suitable equivalents, such as lever arms and the like, may eccentrically support the push rod 60 with respect to the motor shaft and the axle 42 in a manner which will provide for the intended oscillating function.

To enclose the motor 54, an exterior case 62 is integrally or otherwise fixedly secured to the second support column 32 to form an augmented compartment within which the motor 54 may reside. The motor 54 is preferably an electric motor with an oscillation speed control means 26 electrically connected thereto.

Figure 6:
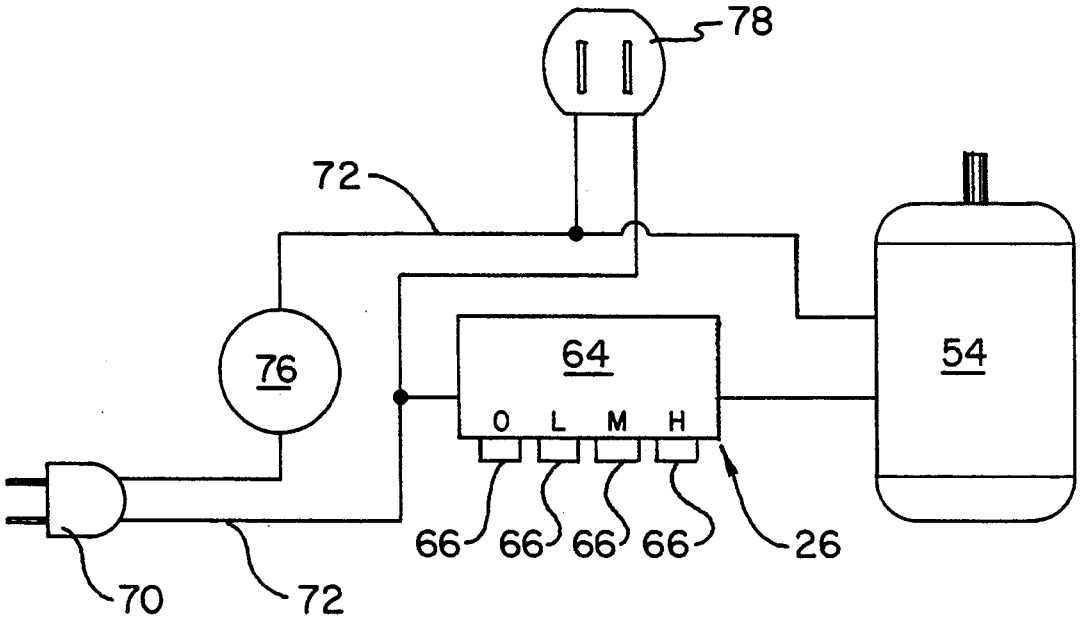
FIG. 6 is a diagrammatic circuitry illustration detailing an electrical interconnection of the invention.

As best illustrated in FIGS. 4 and 6, the oscillation speed control means 26 comprises a speed controller 64 of conventional design having a plurality of speed control buttons 66 which may be selectively operated by a user to control the motor 54. More specifically, the speed controller 64 allows a user to select speeds of the motor 54 ranging from off, low, medium, to high as provided by the selection illustrated in FIG. 6. However, other speed controllers 64 may be utilized which include infinitely variable adjustments and the like.

A power cord 68 is provided and includes a plug 70 which may be engaged to a conventional household electrical socket to provide power to the motor 54 through a plurality of wires 72. In addition, a pair of opposed hooks 74 are mounted to the second support column 32 such that the power cord 68 may be wrapped thereabout for storage.

Another important feature of the invention is provided by a thermostat 76 which is electrically connected to both the motor 54 and an outlet 78, with the outlet 78 being positioned just below the fan support channel 16, as best illustrated in FIGS. 4 and 6. The thermostat 76 is of a conventional design and may be set to any desired temperature such that upon actuation, either the motor 54 or the outlet 78, or both, are de-energized. The outlet 78 is operable to provide power to the fan 18 such that a de-energization of the outlet 78 by the thermostat 76 will turn off the fan. In the preferred embodiment, the thermostat 76 is operable to de-energize both the outlet 78 and the motor 54 upon actuation. However, it should be noted that the thermostat 76 may be electrically coupled exclusively to either the outlet 78 or the motor 54 to effect a selected de-energization thereof in a manner deemed desirable by a user.

In use, the oscillating fan support may be positioned anywhere upon a ground surface, whereby the legs 14 will support the main support column 12 in a vertically extending position. A fan 18, such as a box fan or the like, may be positioned and secured to the fan support channel 16. An unillustrated power cord forming a portion of the fan 18 may then be engaged to the outlet 78, with the power cord 68 of the invention 10 being coupled to a standard household electrical socket. A user may then select an oscillation speed by pushing one of the speed control buttons 66 whereby an oscillating pivotal movement of the fan support channel 16 in the associated fan 18 may commence. To effect selective, unattended de-energization of both the fan 18 and the oscillation means 24, the thermostat 76 may be set to a desired temperature such that upon detection of such temperature within the surrounding ambient air, both the outlet 78 and the motor 54 will be deactivated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oscillating fan support for supporting a fan, said oscillating fan support comprising:

a support column having a top end;

means for supporting said support column in a vertical position;

an elongated fan support channel;

an axle for pivotally mounting said fan support channel in a substantially horizontal plane to said top end of said support column;

an electrical outlet mounted to said oscillating fan support;

an electrical oscillation means for oscillating said fan support channel about a vertical axis;

a thermostat for controlling an energization of both said electrical outlet and said oscillation means in accordance with surrounding ambient air temperature;

and, power cord means for coupling both said electrical outlet and said oscillation means to a power source.

2. The oscillating fan support of claim 1, wherein said oscillation means comprises an electric motor having a motor shaft; a motor wheel having a diameter and being coupled to said motor shaft; an axle wheel having a diameter greater than said motor wheel diameter, said axle wheel being coupled to said axle; a push rod mechanically coupled to both said motor wheel and said axle wheel such that a rotation of said motor wheel results in an oscillation of said axle wheel, said axle, and said fan support channel.

3. The oscillating fan support of claim 2, and further comprising an oscillation speed control means in electrical communication with said motor for selectively controlling a rotational speed of said motor shaft.

4. The oscillating fan support of claim 3, and wherein said fan support channel comprises an elongated planar base plate having edges and a plurality of longitudinally aligned, spaced base plate apertures extending therethrough; a first side wall extending substantially orthogonally and upwardly from one of said edges; and a second side wall extending substantially orthogonally and upwardly from another of said edges, said side walls being spaced and substantially parallel.

5. The oscillating fan support of claim 4, and further comprising a pair of brackets, each of said brackets having a stud which positioned through an individual one of said base plate apertures; and a plurality of thumb screws with each of said brackets having at least one of said thumb screws directed therethrough for selective engagement to said fan.

6. The oscillating fan support of claim 5, wherein said support column comprises a first support column having a plurality of vertically oriented, spaced adjustment apertures; and a second support column telescopically positionable relative to said first support column, said second support column having a second support aperture extending therethrough; and a pin selectively positionable within both said second support aperture and one of said plurality of adjustment apertures to effect selective securement of said second support column relative to said first support column.

* * * * *